US006666205B1

(12) United States Patent
Guo

(10) Patent No.: US 6,666,205 B1
(45) Date of Patent: Dec. 23, 2003

(54) UPRIGHT HEATING BURNER HAVING A HEATSINK DEVICE BACKGROUND OF THE INVENTION

(76) Inventor: Wen Li Guo, No. 10, Fang Dong Rd., Wen Gin Tsuen, Fang Yuan Hsiang, Chang Hua Hsien (TW)

( * ) Notice: Subject to any disclaimer, the term of this patent is extended or adjusted under 35 U.S.C. 154(b) by 0 days.

(21) Appl. No.: 10/316,539

(22) Filed: Dec. 12, 2002

(51) Int. Cl.[7] ..... F24C 3/04

(52) U.S. Cl. ..... 126/92 AC; 126/92 R; 126/248; 126/85 R

(58) Field of Search ..... 126/92 R, 92 B, 126/92 AC, 80, 85 R, 248, 312, 39 J, 92 C; 431/347, 154

(56) References Cited

U.S. PATENT DOCUMENTS 195,794 A * 10/1877 Case ..... 126/67
1,276,886 A * 8/1918 Eberhardt ..... 126/96
1,304,728 A * 5/1919 Baron ..... 126/248
4,469,084 A * 9/1984 Gillotti ..... 126/96
4,487,193 A * 12/1984 Richards et al. ..... 126/58
6,164,273 A * 12/2000 Waters ..... 126/92 B
6,550,470 B2 * 4/2003 Liang ..... 126/92 B

* cited by examiner

*Primary Examiner*—James C. Yeung
(74) *Attorney, Agent, or Firm*—Charles E. Baxley

(57) ABSTRACT

An upright heating burner having a heatsink device includes an upright stand, an upright tube, a burner, an air guide cylinder, and a heatsink device. The heatsink device is mounted on a top of the air guide cylinder and includes an annular support seat, a shaft, and a fan unit. Thus, the fan unit is driven by the heated air to rotate on the shaft automatically, so as to diffuse the heated air outward wholly and completely, thereby efficiently achieving the heatsink effect.

12 Claims, 6 Drawing Sheets

UPRIGHT HEATING BURNER HAVING A HEATSINK DEVICE BACKGROUND OF THE INVENTION

BACKGROUND OF THE INVENTION

1. Field of the Invention The present invention relates to an upright heating burner having a heatsink device, and more particularly to an upright heating burner having a heatsink device that can enhance the heatsink efficiency.

2. Description of the Related Art

A conventional upright heating burner in accordance with the prior art shown in FIGS. 1 and 2 comprises a gas container 10, an upright tube 11, a protective net 15, and a conic cover 16. However, the protective net 15 and the conic cover 16 are heated during a period of time of use, thereby easily injuring the user due to contacting the protective net 15 or the conic cover 16. In addition, the conventional upright heating burner does not have any heatsink device, thereby greatly decreasing the heatsink effect thereof.

SUMMARY OF THE INVENTION

The present invention has arisen to mitigate and/or obviate the disadvantage of the conventional upright heating burner.

The primary objective of the present invention is to provide an upright heating burner having a heatsink device that can enhance the heatsink efficiency.

Another objective of the present invention is to provide an upright heating burner having a heatsink device that can enhance the safety of usage and operation.

A further objective of the present invention is to provide an upright heating burner having a heatsink device, wherein the fan unit of the heatsink device is driven by the heated air to rotate on the shaft automatically, so as to diffuse the heated air outward wholly and completely, thereby efficiently achieving the heatsink effect.

A further objective of the present invention is to provide an upright heating burner having a heatsink device, wherein the protective fence encompasses the air guide cylinder and the conic fence encompasses the heatsink device, so as to prevent the user from contacting the air guide cylinder at a high temperature and the heatsink device during rotation, thereby enhancing the safety of usage and operation of the upright heating burner.

In accordance with the present invention, there is provided an upright heating burner having a heatsink device, comprising an upright stand, an upright tube, a burner, an air guide cylinder, and a heatsink device, wherein:

- the upright tube is mounted on a top of the upright stand;
- the burner is mounted on a top of the upright tube;
- the air guide cylinder is mounted on a top of the burner;
- the heatsink device is mounted on a top of the air guide cylinder and includes an annular support seat, a shaft, and a fan unit, wherein:
  - the support seat is mounted on the top of the air guide cylinder and has an upper portion formed with a support plate having a plurality of radially extended ribs;
  - the shaft is mounted on the upper portion of the support seat of the heatsink device; and
  - the fan unit is rotatably mounted on the shaft and includes an upper frame rotatably mounted on an upper end of the shaft, a lower frame rotatably mounted on a lower end of the shaft, and a plurality of helical blades each mounted between the upper frame and the lower frame.

Further benefits and advantages of the present invention will become apparent after a careful reading of the detailed description with appropriate reference to the accompanying drawings.

DETAILED DESCRIPTION OF THE INVENTION

Figure 3:
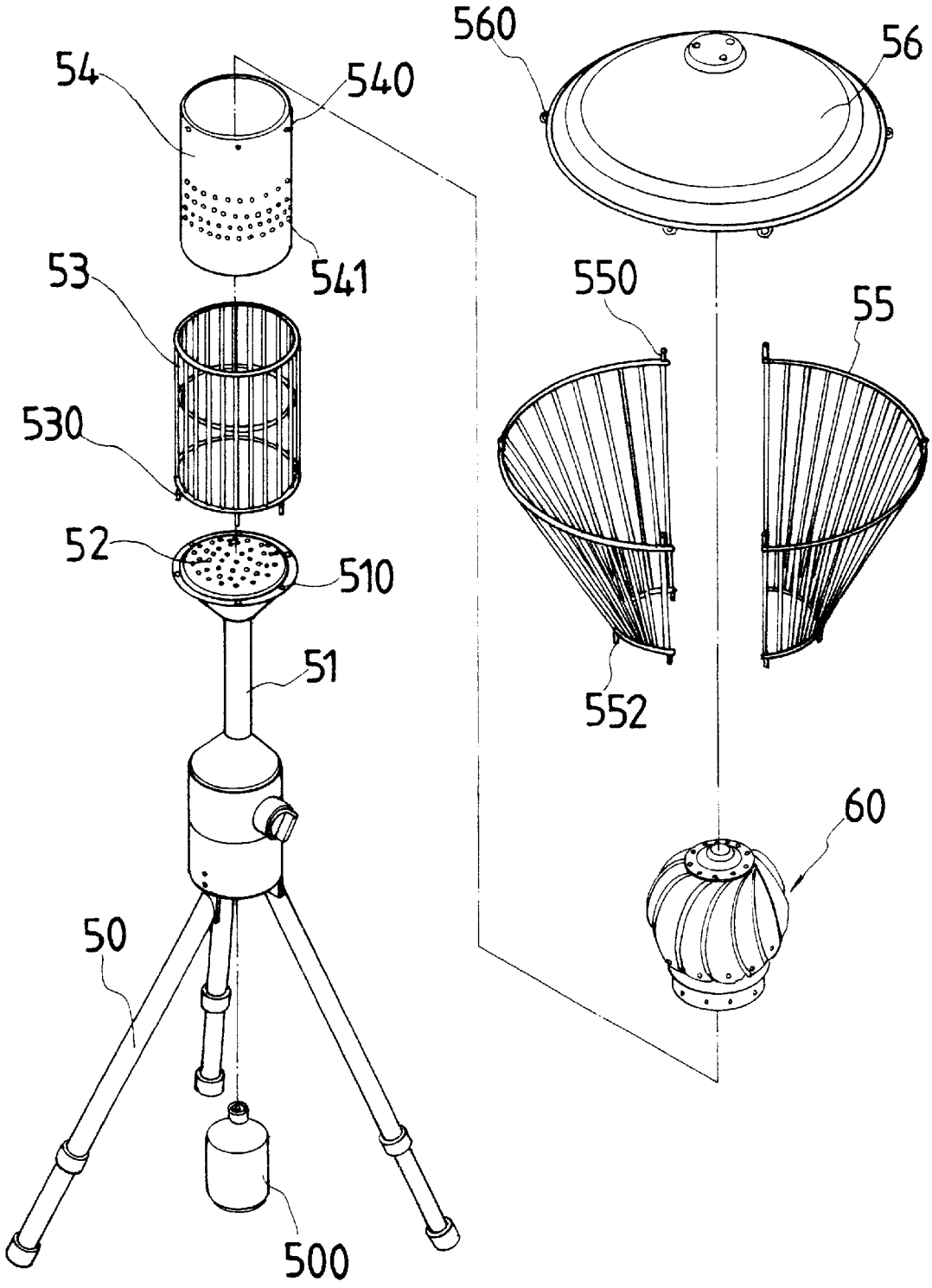
FIG. 3 is a partially exploded perspective view of an upright heating burner having a heatsink device in accordance with a preferred embodiment of the present invention.
Figure 4:
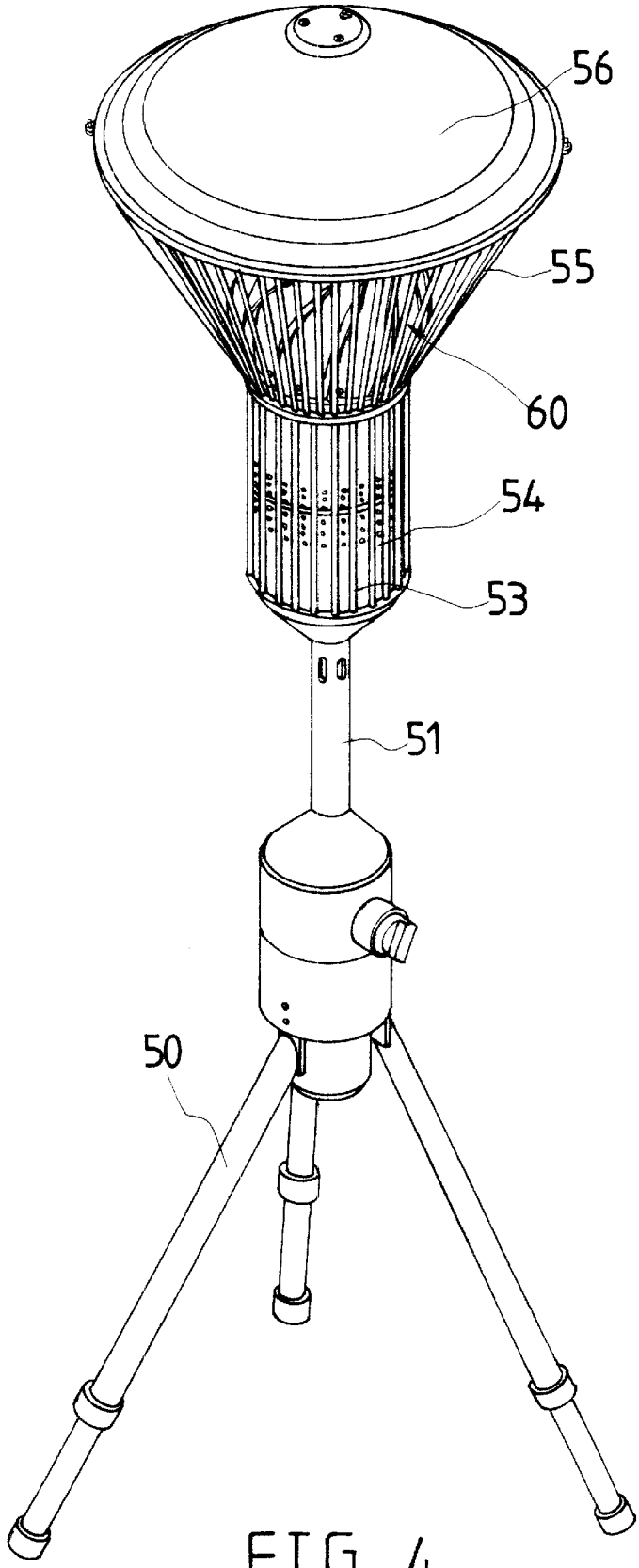
FIG. 4 is a perspective assembly view of the upright heating burner having a heatsink device in accordance with the preferred embodiment of the present invention.

Referring to the drawings and initially to FIGS. 3 and 4, an upright heating burner having a heatsink device in accordance with a preferred embodiment of the present invention comprises an upright stand 50, an upright tube 51, a burner 52, a protective fence 53, an air guide cylinder 54, a conic fence 55, a conic cover 56, and a heatsink device 60.

The upright stand 50 is provided with a gas container 500.

The upright tube 51 is mounted on a top of the upright stand 50 for conveying the gas. The upright tube 51 has a heat insulation effect. The upright tube 51 has a top having a periphery formed with a plurality of insertion holes 510.

The burner 52 is mounted on the top of the upright tube 51.

The protective fence 53 is mounted on the top of the upright tube 51 and has a bottom formed with a plurality of insertion posts 530 each inserted into a respective one of the insertion holes 510 of the upright tube 51.

The air guide cylinder 54 is mounted on a top of the burner 52 and is located in the protective fence 53. The air guide cylinder 54 has a lower portion formed with a plurality of ventilating holes 541 and an upper portion formed with a plurality of through holes 540.

The conic fence 55 is mounted on a top of the protective fence 53. The conic fence 55 has a bottom formed with a plurality of retaining posts 552 each rested on an inner wall of the top of the protective fence 53, so that the conic fence 55 is secured on the top of the protective fence 53. The conic fence 55 has a top formed with a plurality of insertion posts 550.

The conic cover 56 is mounted on a top of the conic fence 55. The conic cover 56 has a periphery of snapping members

560 each snapped on a respective one of the insertion posts 550 of the conic fence 55, so that the conic cover 56 is secured on the top of the conic fence 55.

The heatsink device 60 is mounted on a top of the air guide cylinder 54, and is located in the conic fence 55.

Figure 5:
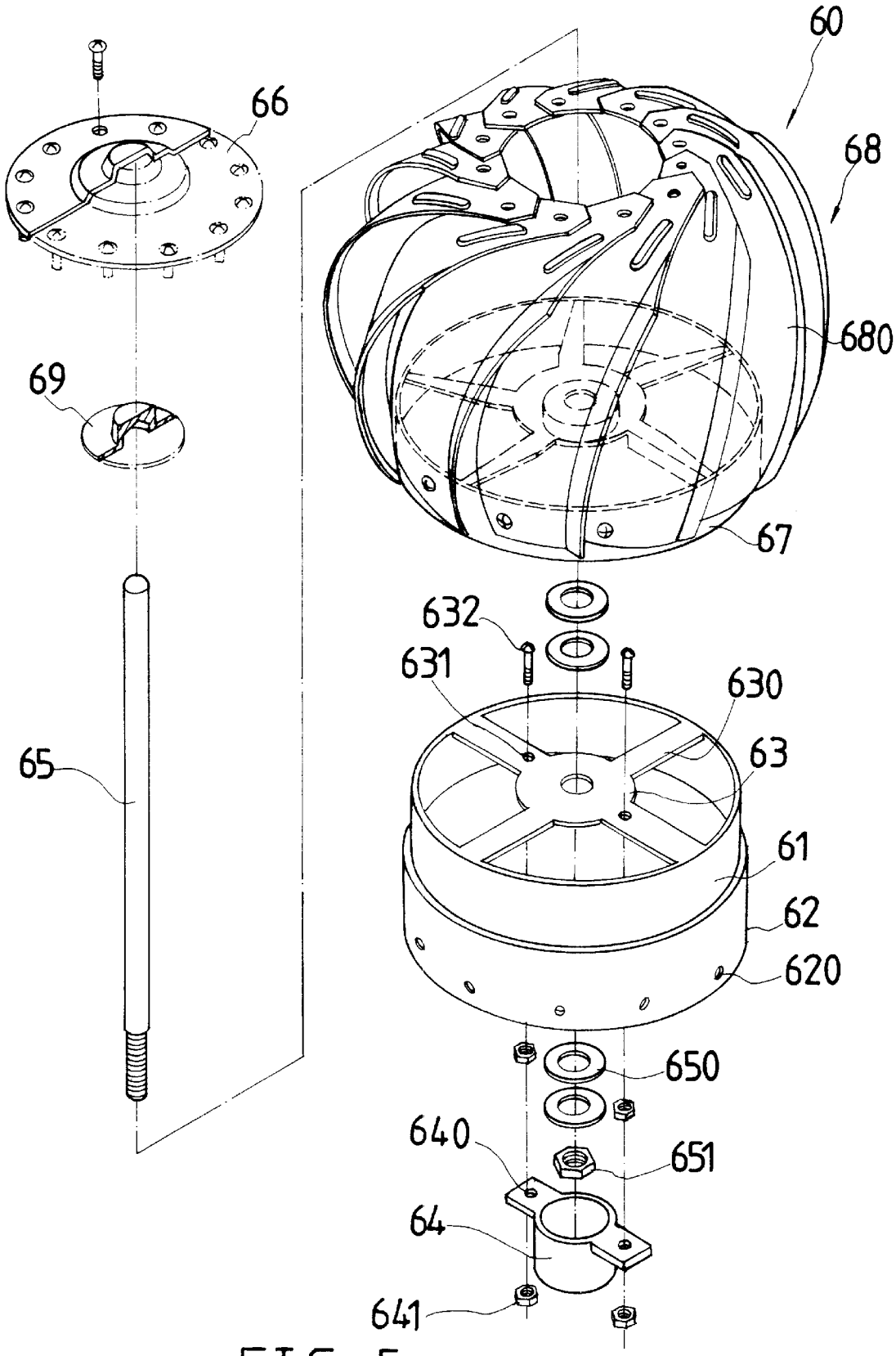
FIG. 5 is an exploded perspective view of a heatsink device of the upright heating burner having a heatsink device in accordance with the preferred embodiment of the present invention.
Figure 6:
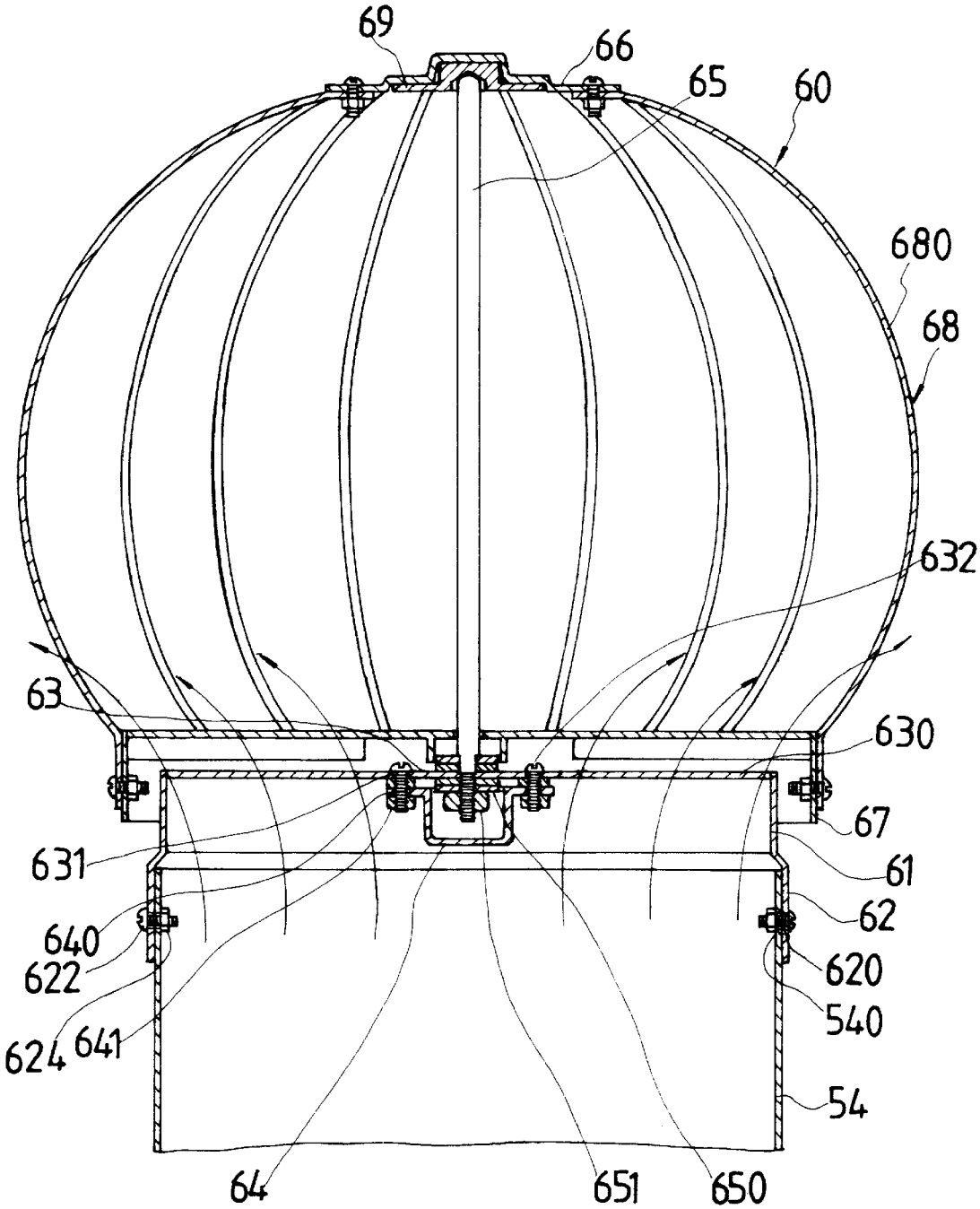
FIG. 6 is a side plan cross-sectional assembly view of the heatsink device of the upright heating burner having a heatsink device as shown in FIG. 5.

As shown in FIGS. 5 and 6 with reference to FIGS. 3 and 4, the heatsink device 60 includes an annular support seat 61, a hollow protective sleeve 64, a shaft 65, a fan unit 68, and a bushing 69.

The support seat 61 of the heatsink device 60 is mounted on the top of the air guide cylinder 54. The support seat 61 of the heatsink device 60 has a lower portion formed with an enlarged mounting sleeve 62 mounted on the top of the air guide cylinder 54 and formed with a plurality of through holes 620 combined with the through holes 540 of the air guide cylinder 54 by a plurality of screws 622 and a plurality of nuts 624, so that the mounting sleeve 62 of the support seat 61 of the heatsink device 60 is fixed on the top of the air guide cylinder 54. The support seat 61 of the heatsink device 60 has an upper portion formed with a support plate 63 having a plurality of radially extended ribs 630.

The support plate 63 of the support seat 61 of the heatsink device 60 is formed with two through holes 631.

The protective sleeve 64 of the heatsink device 60 is mounted on a bottom of the support plate 63 of the support seat 61 of the heatsink device 60. The protective sleeve 64 of the heatsink device 60 is formed with two through holes 640 combined with the through holes 631 of the support plate 63 of the support seat 61 of the heatsink device 60 by two screws 632 and two nuts 641, so that the protective sleeve 64 of the heatsink device 60 is fixed on the bottom of the support plate 63 of the support seat 61 of the heatsink device 60.

The shaft 65 of the heatsink device 60 is mounted on the upper portion of the support seat 61 of the heatsink device 60. The shaft 65 of the heatsink device 60 is fixed on the support plate 63 of the support seat 61 of the heatsink device 60 by a plurality of washers 650 and a screw 651.

The fan unit 68 of the heatsink device 60 is rotatably mounted on the shaft 65 of the heatsink device 60. The fan unit 68 of the heatsink device 60 includes an upper frame 66 rotatably mounted on an upper end of the shaft 65 of the heatsink device 60, a lower frame 67 rotatably mounted on a lower end of the shaft 65 of the heatsink device 60, and a plurality of helical blades 680 each mounted between the upper frame 66 and the lower frame 67. Thus, when the heated air reaches the fan unit 68 of the heatsink device 60, the fan unit 68 of the heatsink device 60 is rotated on the shaft 65 automatically.

The bushing 69 of the heatsink device 60 is mounted on the upper frame 66 of the fan unit 68 of the heatsink device 60 and is rotatably mounted on the upper end of the shaft 65 of the heatsink device 60 to enhance rotation of the fan unit 68 of the heatsink device 60.

Figure 1:
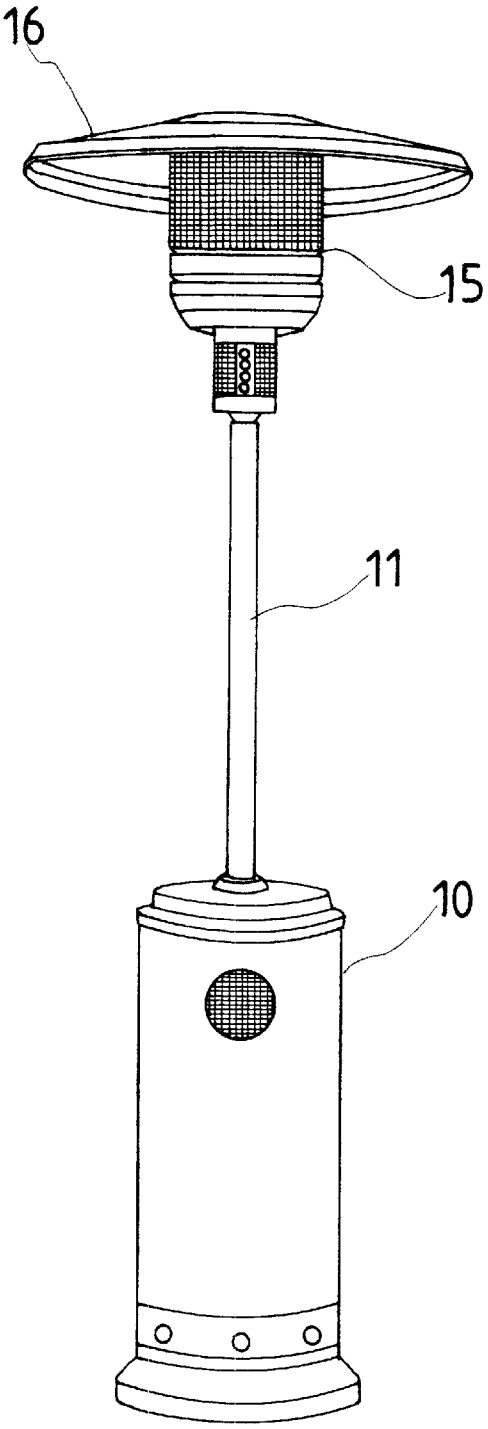
FIG. 1 PRIOR ART
FIG. 1 is a perspective view of a conventional upright heating burner in accordance with the prior art.
Figure 2:
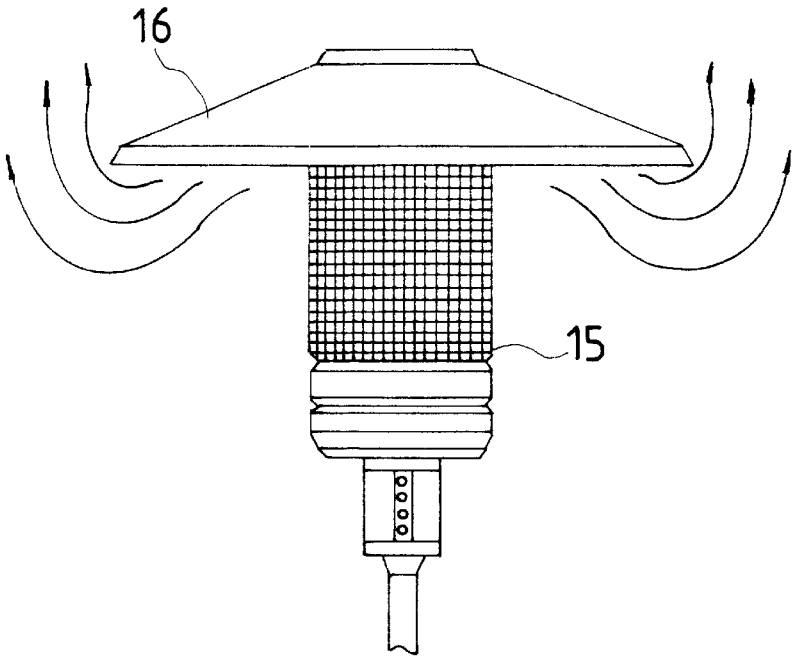
FIG. 2 PRIOR ART
FIG. 2 is a locally enlarged schematic operational view of the conventional upright heating burner having a heatsink device as shown in FIG. 1 in use.
Figure 7:
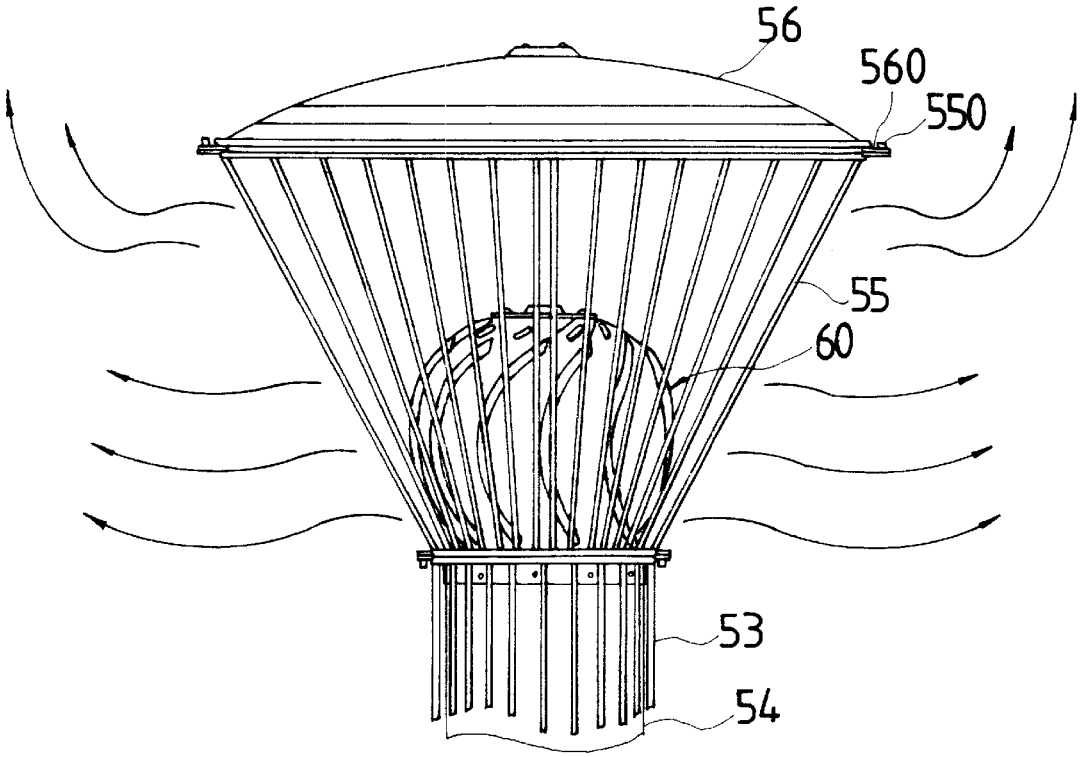
FIG. 7 is a locally enlarged plan schematic operational view of the upright heating burner having a heatsink device as shown in FIG. 4 in use.

In operation, referring to FIGS. 6 and 7 with reference to FIGS. 3–5, after the burner 52 on the top of the upright tube 51 is started, the heated air is produced. The heated air is partially conveyed outward from the ventilating holes 541 of the air guide cylinder 54. Most of the heated air is guided to move upward to the heatsink device 60. In such a manner, the heated air flows upward, and the helical blades 680 of the fan unit 68 of the heatsink device 60 is reduced upward, so that the fan unit 68 of the heatsink device 60 is driven by the heated air to rotate on the shaft 65 automatically, so as to diffuse the heated air outward wholly and completely, thereby efficiently achieving the heatsink effect.

In addition, the protective fence 53 encompasses the air guide cylinder 54 and the conic fence 55 encompasses the heatsink device 60, so as to prevent the user from contacting the air guide cylinder 54 at a high temperature and the heatsink device 60 during rotation, thereby enhancing the safety of usage and operation of the upright heating burner.

While the preferred embodiment(s) of the present invention has been shown and described, it will be apparent to those skilled in the art that various modifications may be made in the embodiment(s) without departing from the spirit of the present invention. Such modifications are all within the scope of the present invention.

What is claimed is:

1. An upright heating burner having a heatsink device, comprising an upright stand, an upright tube, a burner, an air guide cylinder, and a heatsink device, wherein:

the upright tube is mounted on a top of the upright stand;

the burner is mounted on a top of the upright tube;

the air guide cylinder is mounted on a top of the burner;

the heatsink device is mounted on a top of the air guide cylinder and includes an annular support seat, a shaft, and a fan unit, wherein:

the support seat is mounted on the top of the air guide cylinder and has an upper portion formed with a support plate having a plurality of radially extended ribs;

the shaft is mounted on the upper portion of the support seat of the heatsink device; and the fan unit is rotatably mounted on the shaft and includes an upper frame rotatably mounted on an upper end of the shaft, a lower frame rotatably mounted on a lower end of the shaft, and a plurality of helical blades each mounted between the upper frame and the lower frame.

2. The upright heating burner having a heatsink device in accordance with claim 1, wherein the air guide cylinder has an upper portion formed with a plurality of through holes, and the support seat of the heatsink device has a lower portion formed with an enlarged mounting sleeve mounted on the top of the air guide cylinder and formed with a plurality of through holes combined with the through holes of the air guide cylinder by a plurality of screws and a plurality of nuts, so that the mounting sleeve of the support seat of the heatsink device is fixed on the top of the air guide cylinder.

3. The upright heating burner having a heatsink device in accordance with claim 1, wherein the air guide cylinder has a lower portion formed with a plurality of ventilating holes.

4. The upright heating burner having a heatsink device in accordance with claim 1, wherein the support plate of the support seat of the heatsink device is formed with two through holes, and the heatsink device further includes a hollow protective sleeve mounted on a bottom of the support plate of the support seat of the heatsink device and formed with two through holes combined with the through holes of the support plate of the support seat of the heatsink device by two screws and two nuts.

5. The upright heating burner having a heatsink device in accordance with claim 1, wherein the shaft of the heatsink device is fixed on the support plate of the support seat of the heatsink device by a plurality of washers and a screw.

6. The upright heating burner having a heatsink device in accordance with claim 1, wherein the heatsink device further includes a bushing mounted on the upper frame of the fan unit of the heatsink device and rotatably mounted on the upper end of the shaft of the heatsink device.

7. The upright heating burner having a heatsink device in accordance with claim 1, wherein the upright tube has a top having a periphery formed with a plurality of insertion holes, and the upright heating burner further comprises a protective fence mounted on the top of the upright tube and having a bottom formed with a plurality of insertion posts each inserted into a respective one of the insertion holes of the upright tube.

8. The upright heating burner having a heatsink device in accordance with claim 7, wherein the air guide cylinder is located in the protective fence.

9. The upright heating burner having a heatsink device in accordance with claim 7, further comprising a conic fence mounted on a top of the protective fence and having a bottom formed with a plurality of retaining posts each rested on an inner wall of the top of the protective fence, so that the conic fence is secured on the top of the protective fence.

10. The upright heating burner having a heatsink device in accordance with claim 9, wherein the heatsink device is located in the conic fence.

11. The upright heating burner having a heatsink device in accordance with claim 9, further comprising a conic cover mounted on a top of the conic fence.

12. The upright heating burner having a heatsink device in accordance with claim 11, wherein the conic fence has a top formed with a plurality of insertion posts, and the conic cover has a periphery of snapping members each snapped on a respective one of the insertion posts of the conic fence, so that the conic cover is secured on the top of the conic fence.

* * * * *